United States Patent [19]

Amos et al.

[11] 3,990,810

[45] Nov. 9, 1976

[54] VANE ASSEMBLY FOR CLOSE COUPLING THE COMPRESSOR TURBINE AND A SINGLE STAGE POWER TURBINE OF A TWO-SHAPED GAS TURBINE

[75] Inventors: David J. Amos, Wallingford, Pa.; Taku Ichiryu, Kakogawa; Tomohiko Sato, Kobe, both of Japan

[73] Assignee: Westinghouse Electric Corporation, Pittsburgh, Pa.

[22] Filed: Dec. 23, 1975

[21] Appl. No.: 643,718

[52] U.S. Cl. ..... 415/161

[51] Int. Cl.[2] ..... F01D 17/14

[58] Field of Search ..... 415/160, 161, 162

[56] References Cited

UNITED STATES PATENTS

| | | | |
|---|---|---|---|
| 2,838,274 | 6/1958 | Fletcher et al. | 415/161 |
| 2,950,084 | 8/1960 | Perry | 415/160 |
| 3,674,377 | 4/1972 | Trappmann | 415/160 |
| 3,695,777 | 10/1972 | Westphal et al. | 415/160 |
| 3,887,297 | 6/1975 | Welchek | 415/161 |

FOREIGN PATENTS OR APPLICATIONS

| | | | |
|---|---|---|---|
| 736,796 | 9/1955 | United Kingdom | 415/161 |
| 755,527 | 8/1956 | United Kingdom | 415/161 |
| 774,501 | 5/1957 | United Kingdom | 415/161 |
| 805,015 | 11/1958 | United Kingdom | 415/160 |
| 946,995 | 1/1964 | United Kingdom | 415/161 |

*Primary Examiner*—Henry F. Raduazo
*Attorney, Agent, or Firm*—F. A. Winans

[57] ABSTRACT

A vane assembly is shown for a relatively short annular transition zone directing the discharge of the working fluid from the compressor turbine to a single stage power turbine in a gas turbine engine. The annular transition zone comprises a plurality of individual arcuate segments having a pair of stationary vanes integrally molded to inner and outer shroud members. A variable vane is disposed immediately downstream of each stationary vane for guiding the working fluid into the power turbine at an optimum angle. The variable vanes are manually adjustable from outside the turbine casing through a linkage and support mechanism that maintains a constant clearance between the variable vane and the shroud members and also accommodates variations in dimensional relationships due to temperature variations. Also, provision is made for centering the axis of the variable vanes to a precise position with respect to the stationary vane to accommodate the buildup of assembly tolerances.

8 Claims, 5 Drawing Figures

VANE ASSEMBLY FOR CLOSE COUPLING THE COMPRESSOR TURBINE AND A SINGLE STAGE POWER TURBINE OF A TWO-SHAPED GAS TURBINE

BACKGROUND OF THE INVENTION

1. Field of the Invention

This invention relates to an annular transition duct connecting the last stage of a compressor turbine to a single stage of a power turbine of a two-shafted gas turbine.

2. Description of the Prior Art

This invention is an improved form of the invention described in copending application Ser. No. 620,608, filed Oct. 8, 1975 of common assignee. In the above-identified application the annular transition duct for a two-shafted gas turbine is shown having diverging opposed walls or shroud members neccessitated by the variation in annular diameters between the last stage of the compressor turbine and the single stage power turbine. In order to maintain the velocity of the working fluid generally undiminished as it passes therethrough, the duct contains stationary vanes having a particular configuration and angular relationship to offset the otherwise increasing area provided by the diverging shrouds. Variable vanes are also disposed within the shrouds generally downstream of the stationary vanes to direct the working fluid into the power turbine stage at an angle determined by the intended speed of operation of the power turbine. Also, a constant clearance was maintained between the ends of the variable vanes and the adjacent shroud member by each end of the vane and the adjacent shroud member defining a spherical segment having common centers to define concentric arcuate surfaces. The axis of the angular movement of the variable vane was angled with respect to the axis of the turbine so that the discharge end of the transition zone was substantially tangent to the entry into the power turbine stage providing a flow path free of abrupt directional changes. In the instant application, all the above features remain, however, the variable vanes of the instant application are disposed immediately adjacent the downstream edge of the stationary vanes to form a single generally continuous airfoil surface across the axial extent of the transition zone. Further, particular mounting structure is shown which permits transient growth in the shroud or vanes while maintaining their set angular position and clearance between adjacent parts.

SUMMARY OF THE INVENTION

This invention provides, in an annular transition zone of the above-identified characteristics, a combination stationary vane and variable vane arrangement and assembly including particular mounting structure of the variable vane to permit various angular settings for maintaining the clearance between the vane and the adjacent shroud member constant and allowing for dimensional variation caused by extreme temperature variations to which the vane and shroud members are exposed.

DESCRIPTION OF THE PREFERRED EMBODIMENT

Figure 1:
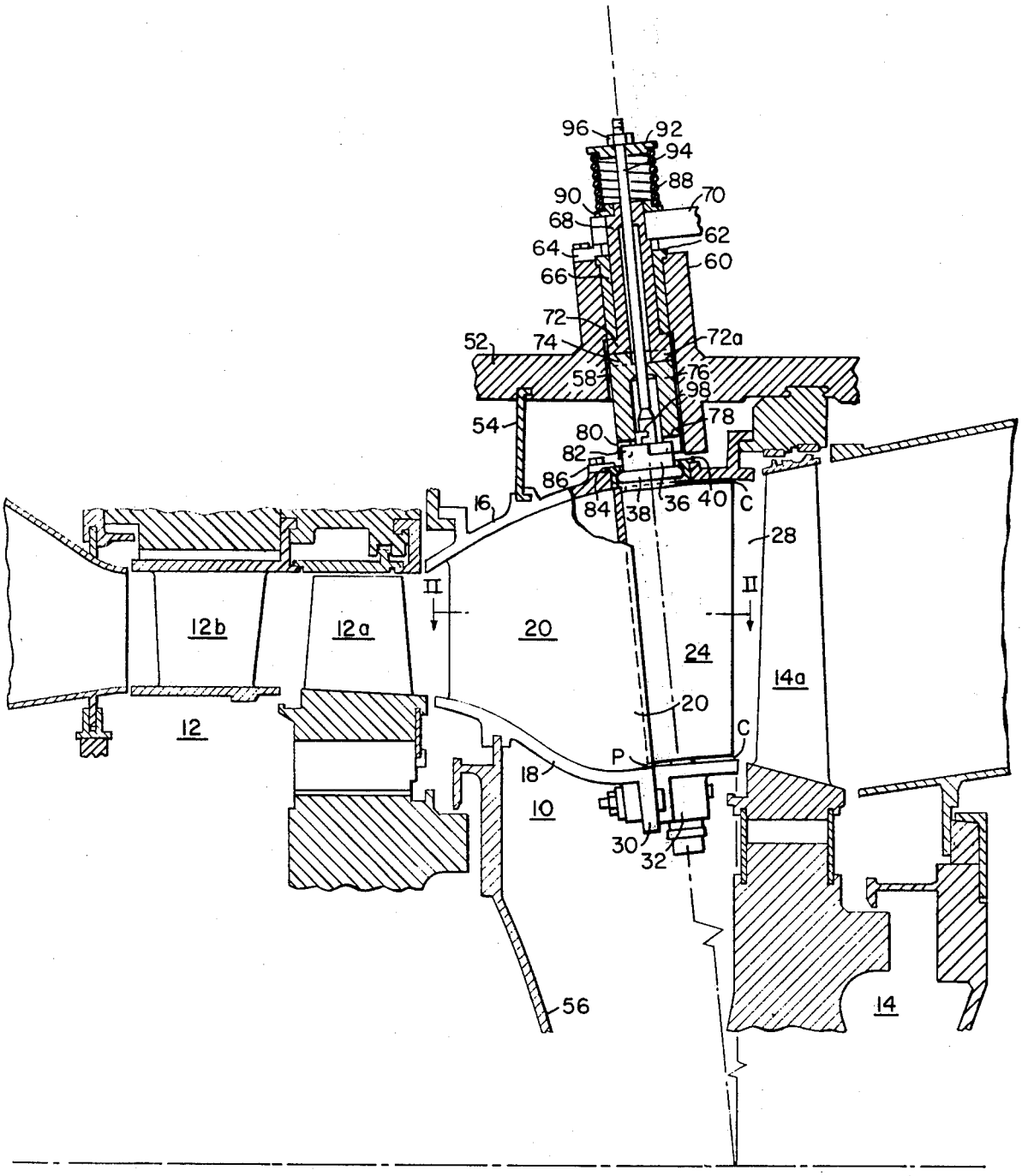
FIG. 1 is a cross sectional elevational view of a single arcuate segment of the annular transition zone or duct taken generally along the axis of the variable vanes.

The present invention is directed to an annular passage or duct 10 interconnecting the last stage 12 of the compressor to a single stage 14 of a power turbine of a two-shafted gas turbine engine. For purpose of this description, such duct 10 will be referred to as a transitional zone in that the working or motive fluid enters the zone in an annular area generally concentric with the relatively small compressor blades 12*a* and exits in a much larger annular area generally concentric with the larger power turbine blades 14*a*. (The power turbine has only a single stage and the leaving losses are minimized by a large annulus that slows the exhaust gas to a minimum.) Thus, referring to FIG. 1, that portion of the turbine is shown with contains the motive fluid flow path through the transition zone commencing with the compressor turbine guide vane 12*b* and the compressor turbine blade 12*a* and terminating with the power turbine blades 14*a*. With attention being specifically directed to the transition zone 10 it is seen to comprise top and bottom annular wall members 16, 18 forming the inner and outer shrouds respectively. The shrouds diverge in the direction of flow to a point p about midway of the axial distance therethrough whereupon they become generally parallel. (More precisely as explained in the previous identified copending application, from generally this point to the exit end of the zone they are concentric spherical segments.)

Figure 2:
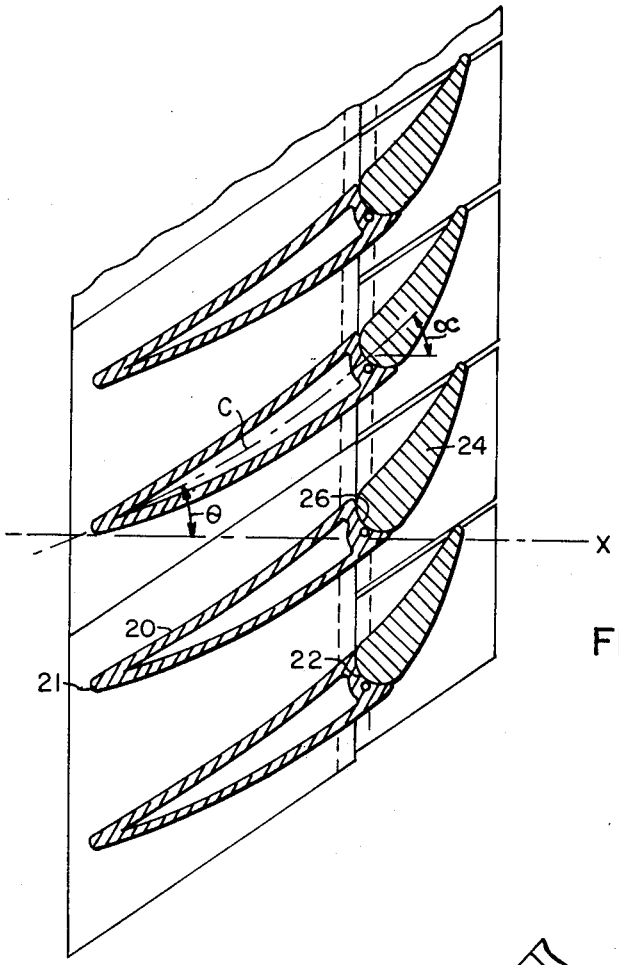
FIG. 2 is a cross sectional view along line II—II of FIG. 1.

From the entry end to this midpoint, the opposing shrouds are interconnected by radial stationary vanes or struts 20 (i.e. 60–70 equa-angularly spaced about the annulus). As seen in FIG. 2, these struts 20 have an increasing thickness in the downstream direction from their entry edge 21 to their trailing edge 22. Also, the struts are angled with respect to the axial direction, with the entry angle $\theta$ being determined from the swirl component of the working fluid so as to have essentially a zero degree angle of incidence between the directional flow of the working fluid and the vane. Further, the angular relationship between the axis of the turbine ($x$ in FIG. 2) and the camber line C of the vane 20 continuously increases from $\theta$ to the final angle $\alpha$. This increase in angle has the effect of diminishing the distance between adjacent struts 20 which in conjunction with their increasing thickness counteracts the increasing area provided by the diverging shrouds 16, 18 to maintain the flow area generally constant and thereby the velocity of the working fluid generally constant throughout this annular duct. (This relationship was previously explained in the identified related copending application.)

Still referring to FIG. 2, it is seen that a variable vane 24 is disposed immediately adjacent in nested relationship with a concave surface 26 on the trailing edge of the stationary vane. The variable vane 24 extends radially across the opposing shrouds 16, 18, with each end maintained at a constant clearance between it and the adjacent shroud member regardless of the angular orientation of the vane 24.

Figure 3:
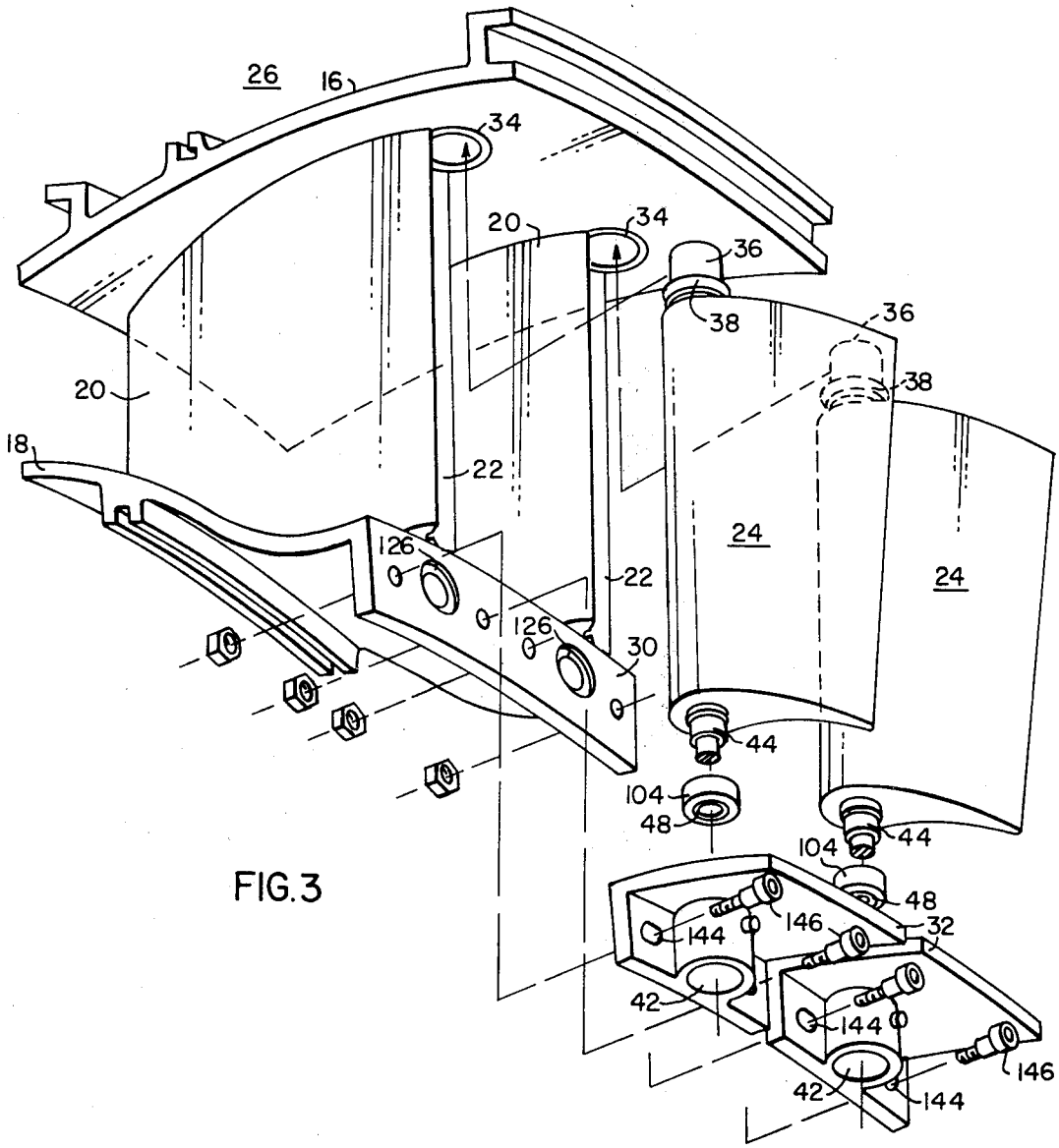
FIG. 3 is an exploded isometric view of a single segment of the shroud and vane assembly of the present invention.

As a practical matter, the complete annular transition zone 10 is comprised of discrete segments 26 as best seen in FIG. 3. Each segment comprises the top and bottom shroud 16, 18 integrally cast with a pair of stationary struts 20. The top wall or outer shroud 16 extends axially to the exit end 28 of the zone 10 whereas the bottom wall or inner shroud 18 terminates adjacent the trailing edge 22 of the strut 20 in a downturned lip providing a flange 30 for proper engagement with separate inner shroud plateforms 32. The outer shroud member 16 contains appropriate sized apertures 34 for receiving a top pin 36 integrally cast with the variable vane 24. The top pin 36 includes an integrally cast collar portion 38 providing a spherical bearing surface for seating within a bearing seat 40 as seen in FIG. 1.

Each separate platform 32 also contains appropriately sized apertures 42 for receipt of a bottom pin 44 integrally cast with the variable vanes 24. The bottom pin 44 telescopically receive a spherical bearing 48 for relative radial movement therebetween to accommodate dimensional variations produced by extreme temperature variations to which this section of the turbine is subjected.

Figure 4:
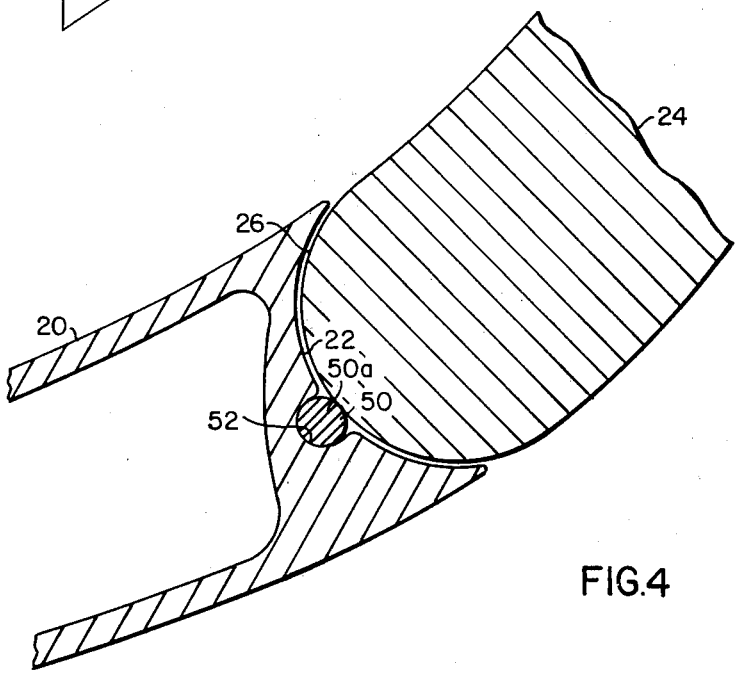
FIG. 4 is an enlarged cross sectional view taken along line IV—IV of FIG. 1; and, FIG. 5 is an enlarged elevational view of the lower bearing and centering arrangement for the variable vane of FIG. 1.

In that each stationary vane 20 and its associated variable vane 24 provide a generally single airfoil surface which is angled with respect to the axis of the engine, one side of the airfoil is exposed to the high pressure discharge of the compressor and the other is generally exposed to the low pressure power turbine. To prevent leakage between the nested interface of the stationary vane 20 and the variable vane 24, a seal pin 50 as seen in FIG. 4 is disposed in a radial groove 52 provided in the concave face 22 of the stationary vane 20. The pin 50 has an arcuate portion 50*a* projecting outwardly of the normal contour of the trailing edge 22 of the stationary vane sufficiently to engage the mating nested convex edge 26 of the variable vane in a substantial line engagement along its radial extent.

Referring again to FIG. 1, it is seen that the annular transition zone 10 is enclosed by the annular turbine casing 52, with an annular seal member 54 disposed between the casing and the outer shroud 16 and a diaphragm seal member 56 disposed between the rotor (not shown) and the inner shroud 18.

Manually adjusting means extend through the casing 52 for manipulating the angular orientation of the variable vane 24 from the outside casing. This mechanism is shown in FIG. 1 and as there is seen comprises an opening 58 in the outer casing surrounded by a radially extending collar portion 60. The collar portion seats an internal T-shaped bearing member 62. A bearing retainer 64 is secured (as by a bolt) to the top of the collar member 60 with a portion overlapping the bearing member to prevent its outward movement. An inverted T-shaped hollow actuating rod 66 is received within the bearing 62 having an exterior end 68 extending above the collar member for indexed receipt of an actuating handle 70. The inner end 72 of the rod defines the cross member of the T-shape and has a lower surface that defines projections 72*a* for engaging like indentations 74 in an intermediate hollow tube section 76 which in turn has a lower surface 78 defining projections 80 for engagement with indentations 82 in the upper surface of the top pin 36 integrally cast with the variable vane 24. This intermediate tube 76 provides a knuckle or universal type joint so that small annular displacement of the casing with respect to the shroud can be accommodated without breakage or without varying the angular setting.

As previously noted, the top pin 36 of the variable vane 24 has an integral spherical bearing 38. This bearing 38 is received in a bearing seat 40 which in turn is disposed in an appropriately sized aperture 34 in the top shroud. The bearing seat 40 in addition to engaging the bearing surface 38 provides a top flange 84 for engagement with a bearing retainer member 86 bolted to the outside of the top shroud 16. The flange 84 thus retained between the shroud 16 and the retainer 86 is prevented from radial (i.e. vertical in FIG. 1) movement.

It is to be understood that the fit of the bearing seat 40 on the shroud 16 and the bearing seat are held to relatively close tolerances as it is the radial positioning mechanism of the vane that establishes the clearance C between the vane and the shroud. This clearance C is desired to be minimized without leakage from the high pressure to the low pressure side. Thus, to maintain the vane 24 and the bearing seat 40 in one constant relationship, the vane is maintained under tension against the bearing seat 40 by a radial thrust tension spring 88 having one end received on a washer 90 above the handle 70 to act therethrough to transmit a force to the outer casing 52. The opposite end of the spring is also received on a washer 92 having an opening through which the thrust rod 94 extends. The rod 94 terminates in a threaded end for receipt of a nut 96 on the outer surface of the washer 92. The opposite end of the rod 94 engages a projection 98 on the top pin 36 of the variable vane and thus, the expansive thrust of the spring 88 is transferred through the rod 94 to maintain a radial tension on the vane so that the vane remains in a single established seating engagement with the bearing seat over all operating conditions.

As previously discussed in reference to FIG. 3, the inner shroud platforms 32 are individually mounted to the integrally cast strut and shroud structure 26. Such platforms are mounted in a manner to accommodate radial variations in the dimensions (i.e. along the turning axis) of the variable vane due to temperature variations. Also, as they in conjunction with the top bearing seat, determine the turning axis of the variable vanes, provision is made for adjusting the assembled position for centering the lower bearing aperture 42 to account for manufacturing tolerance buildup.

Figure 5:
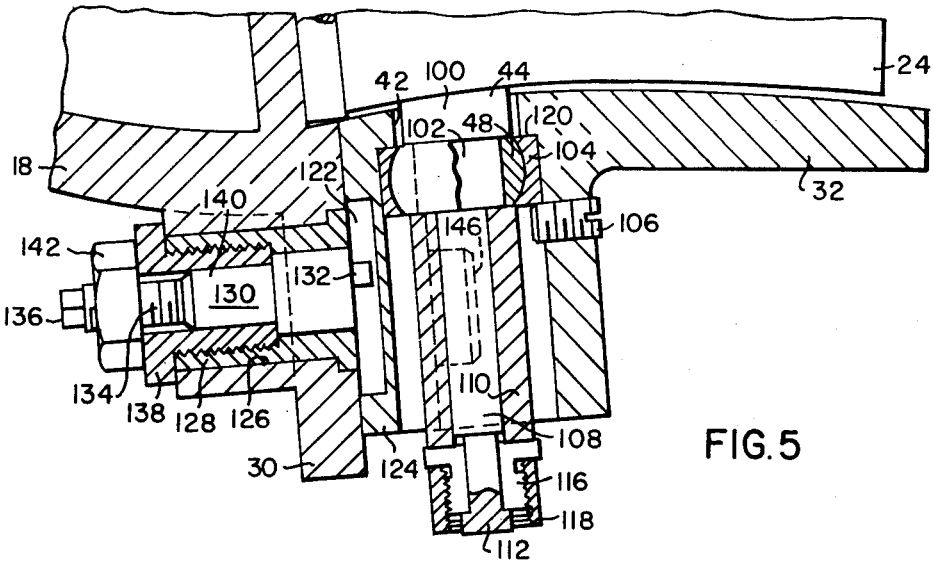

Referring now to FIG. 5, an enlarged section through the platform 32 shows both of the above features. Thus the lower pin 44 of the vane 24 includes an initial section 100 of a diameter to fit within the aperture 42 in the platform 32, and an intermediate 102 section of smaller diameter for telescopic receipt of the spherical bearing member 48. The spherical bearing member 48 is encircled by an inner spherical bearing seat 104 which in turn is held in position against turning by a locking screw 106. The pin 44 has a lower or inner portion 108 of yet lesser diameter extending to a position exteriorly of the platform. This portion 108 is encircled in a cylindrical sleeve 110. The pin terminates in an inverted T-shape 112 with the stem portion of the T providing a small diameter and the cross member having external threads 114. A split ring 116 is inserted over the stem portion and an internally threaded nut 118 is threaded over the cross member so that tightening the nut places a tightening force on the split ring 116 which in turn tightens the bearing 48 and bearing seat 104 onto the pin and against a seating lip 120 on the underside of the platform coaxial with the aperture 42. Thus, during expansion of the vane 24, the shroud platform 32 is forced inwardly (i.e. toward the axis of the engine) by abutment of the pin 100 on the bearing 48 and bearing seat 104 which in turn abuts the lock screw 106 of the platform. During contraction, the force is transmited from the threaded nut 118 through the split ring 116 to the sleeve 110 which in turn abuts the bearing 48 and bearing seat 104 for retraction of the platform through engagement with the lip 120.

To center the platform 32, a radial groove 122 is provided in the platform in a flange section 124 which is in facing engagement with the mating flange 30 of the inner shroud 18. The inner shroud flange contains a countersunk opening 126 for receipt of a T-shape sleeve member 128 which on the stem portion opposite the head of the T is internally threaded. A centering pin 130 comprises an enlarged cylindrical midportion with a pin 132 member extending from an eccentric location from a planar face of the midportion for receipt in the groove 122 of the platform when the midportion is disposed in the sleeve. The opposite end of the centering pin 130 is reduced in diameter and has external threads 134 terminating in a head 136 particularly adapted for engagement by a tool (such as a square head for engagement by a wrench or the like). A second T-shaped sleeve 138 is externally threaded along its stem for engagement with the first sleeve 128 and provides a reduced internal diameter for receiving a reduced diameter section 140 of the midportion of the centering pin 130 to prevent outward movement thereof. Finally a threaded nut 142 is fastened to the centering pin to lock it in final adjusted position. To make a centering adjustment, the apertures 144 for the mounting screws 146 (see FIG. 3) are somewhat oversize to permit limited movement of the platform when they are loose. Thus, in their loosened condition, the lock nut 142 is loosened and the centering pin 130 is turned which moves the eccentric 132 either into or out of the page according to the FIG. 5 view. This movement contacts the groove 122 and moves the platform in like direction. When the platform has been moved to the extent necessary to align the axis of the variable vane 24 with the concave surface 22 of the stationary vane 20, the lock nut 142 is tightened and the mounting bolts 146 are tightened to secure the platform in this position.

Thus, a generally integral vane assembly is shown, being one of an annular array of such segments, which comprise an annular short transition portion or zone for close coupling of a compressor turbine to a power turbine of a two-shafted gas turbine. The transition portion, although increasing in annular area for a large entry into the single stage of the power turbine, contains stationary struts or vanes that, through their increasing width and angular orientation, maintain the working fluid at a generally constant velocity through the zone. Variable vanes are provided in each segment to coincide with the downstream portion of the stationary vanes to optimally direct the fluid into the power turbine. The variable vanes are manually adjustable from outside the turbine casing through a linkage that maintains a constant clearance between the vane and the opposed shroud defining the zone and also accommodates variations in dimensional relationships due to temperature variations. During assembly of the variable vanes, they are adjustable to a precise position to accommodate the buildup of assembly tolerances.

What we claim is:

1. In a gas turbine engine having a closely coupled fluid flow path between the compressor turbine and the power turbine, said path defined by an annular duct comprising:

opposed radially inner and radially outer arcuate shroud members extending axially between the discharge area of said compressor turbine and the inlet area of said power turbine;

at least one stationary vane extending radially across and interconnecting said shroud members generally adjacent said compressor turbine discharge area, a pivotable vane extending radially between said shroud members generally adjacent the power turbine inlet area and providing opposed projections extending generally radially from the opposed ends of said vane for receipt in inner and outer bearing structure supported in said respective shroud members, means for adjusting the angular orientation of such pivotable vane exteriorly of the casing of said engine and;

means for maintaining a unidirectional biasing force on said vane to positively seat the vane in a predetermined relationship with respect to said outer shroud member to maintain a pre-set minimal clearance gap between said variable vane and said outer shroud member and, means forming the part of said inner shroud member supporting said inner bearing structure and mounted to the adjacent portion of said inner shroud member for radial movement with respect thereto in accordance with the expansion and contraction of said pivotable vane to maintain a pre-set minimal clearance gap between said variable vane and said bearing supporting part of said inner shroud member.

2. Structure according to claim 1 wherein the downstream end of said stationary vane and the upstream end of said rotatable vane define complementary nested surfaces and means providing a generally sealing engagement therebetween along their common radial extent and, means for adjusting the position of said bearing supporting part of said inner shroud member with respect to said bearing structure in said outer shroud member to, upon assembly, adjust the axis of said rotatable vane to maintain said sealing engagement with said stationary vane to accommodate assembly tolerance build-up.

3. Structure according to claim 2 wherein said pivotable vane adjusting means includes at least a two-piece member extending from engagement with the upper radial projection of said variable vane to exteriorly of said casing, with the juncture between the exteriorly extending portion and the vane engaging portion providing a knuckle for accommodating relative displacement of the casing with respect to the vane caused by expansion or contraction.

4. Structure according to claim 2 wherein said means for maintaining a unidirectional biasing force comprises:

rod means engaging said upper radial projection of said variable vane and extending exteriorly of said casing, spring means biasing said rod means in a radially outwardly direction, means engaging and seating a bearing surface surrounding said projection, said means disposed within said outer shroud member and, retaining means for securing said engaging and seating means in a predetermined position, whereby, the upward force on said vane by said spring maintains said bearing surface in said engaging means in the most radially outward permitted position to minimize the clearance between said vane and said outer shroud member.

5. A vane and shroud assembly for an annular transition portion between the compressor turbine and power turbine of a gas turbine engine comprising a plurality of individual arcuate segments defined by radially opposed inner and outer shroud members integrally molded with at least one stationary vane extending therebetween, a pivotable vane disposed therebetween downstream of said stationary vane and generally forming a continuous surface therewith to provide an airfoil shaped contour, said pivotable vane having a projection extending generally radial from each end thereof, bearing seating means housed within the outer shroud for engaging the radially outer projection, a platform member movably attached to and forming a part of the inner shroud and housing a bearing means for engaging the radially inner projection, biasing means connected to said outer projection to maintain an outward force on said pivotable vane to maintain a constant seating relationship of said projection in said outer bearing seating means and a constant clearance of said variable vane relative to said outer shroud, means interconnecting said inner projection and said inner bearing means for causing radial movement of said platform in correspondence to expansion or contraction of said pivotable vane and, means connected to said inner shroud for aligning said inner bearing seat with respect to said outer bearing seat for establishing generally precisely the axis of said pivotable vane.

6. Structure according to claim 5 wherein the downstream end of said stationary vane and the upstream end of said rotatable vane define complementary nested surfaces providing a generally sealing engagement therebetween along their common radial extent.

7. Structure according to claim 6 including adjusting means for manually setting the angular orientation of said vane exteriorly of the casing of said engine comprising a two piece member extending from engagement with the upper radial projection to a position exteriorly of said casing, with the juncture between the two separate portions providing a knuckle to accommodate relative displacement of the casing with respect to the vane caused by expansion or contraction.

8. Structure according to claim 6 wherein said means for maintaining a unidirectional biasing force comprises:

rod means engaging said upper radial projection of said variable vane and extending exteriorly of said casing, spring means biasing said rod means in a radially outwardly direction, means engaging and seating a bearing surface surrounding said projection, said means disposed within said outer shroud member and, retaining means for securing said engaging and seating means in a predetermined position, whereby the radially outward force on said vane by said spring maintains said bearing surface in said engaging means in the most radially outward permitted position to minimize the clearance between said vane and said outer shroud member.

* * * * *